US009281142B2

(12) United States Patent
Sawada et al.

(10) Patent No.: US 9,281,142 B2
(45) Date of Patent: Mar. 8, 2016

(54) KEYBOARD DEVICE

(71) Applicant: ROLAND CORPORATION, Shizuoka (JP)

(72) Inventors: Mutsuo Sawada, Shizuoka (JP); Shiro Uno, Shizuoka (JP)

(73) Assignee: ROLAND CORPORATION, Shizuoka (JP)

( * ) Notice: Subject to any disclaimer, the term of this patent is extended or adjusted under 35 U.S.C. 154(b) by 388 days.

(21) Appl. No.: 13/970,615

(22) Filed: Aug. 20, 2013

(65) Prior Publication Data

US 2014/0083830 A1 Mar. 27, 2014

(30) Foreign Application Priority Data

Sep. 26, 2012 (JP) ..... 2012-213040

(51) Int. Cl.
*G10C 3/12* (2006.01)
*H01H 13/7065* (2006.01)
*G10H 1/34* (2006.01)

(52) U.S. Cl.
CPC ..... *H01H 13/7065* (2013.01); *G10H 1/346* (2013.01); *G10C 3/12* (2013.01)

(58) Field of Classification Search
CPC ..... H01H 13/7065; G10C 3/18
See application file for complete search history.

(56) References Cited

U.S. PATENT DOCUMENTS 5,204,486 A * 4/1993 Kim ..... G10H 1/346 84/433
5,574,241 A * 11/1996 Kumano ..... G10H 1/346 84/433
6,930,234 B2 * 8/2005 Davis ..... G10H 1/346 84/423 R
8,445,765 B2 * 5/2013 Sawada ..... G10H 1/346 84/423 R
2008/0307944 A1 * 12/2008 Watanabe ..... G10C 3/12 84/433
2012/0174729 A1 * 7/2012 Sawada ..... G10H 1/346 84/236
2014/0083830 A1 * 3/2014 Sawada ..... H01H 13/7065 200/343

* cited by examiner

*Primary Examiner* — Robert W Horn
(74) *Attorney, Agent, or Firm* — Jianq Chyun IP Office

(57) ABSTRACT

A keyboard device capable of suppressing noise that occurs upon release of the key is provided. The key is formed with a protrusion and a hammer is formed with a sliding surface. Moreover, the hammer is provided with contact portions that come into contact with a side surface of the protrusion when the key is pressed to the bottom in a key-pressing direction. Thus, when the key is released, the contact between the side surface of the protrusion and the contact portions prevents the key from rotating before the hammer, thereby preventing the protrusion from departing from the sliding surface and suppressing the generation of noise that occurs when the protrusion falls on (hits) the sliding surface.

14 Claims, 9 Drawing Sheets

FG.5B

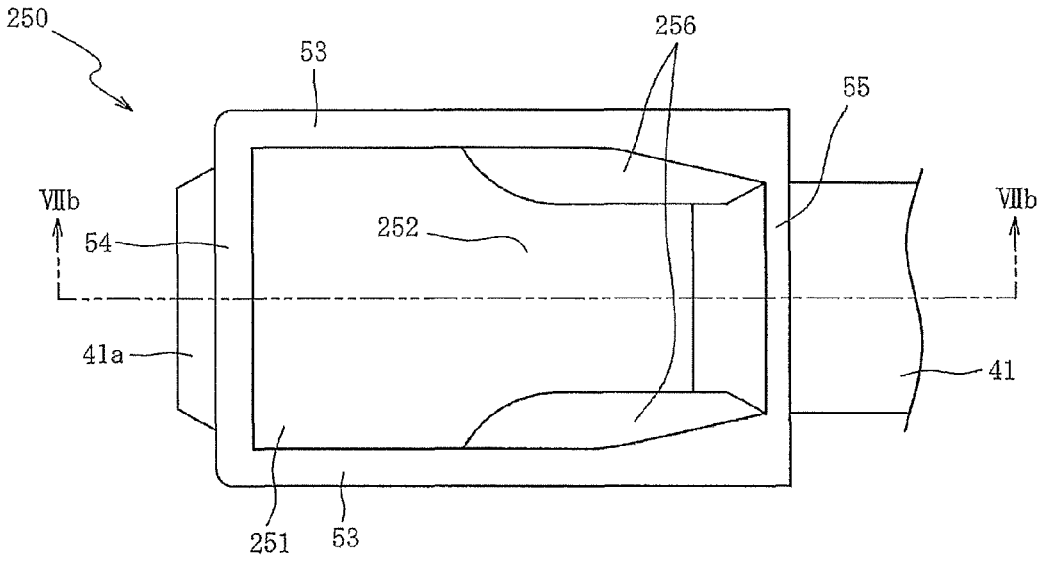
FIG.7A
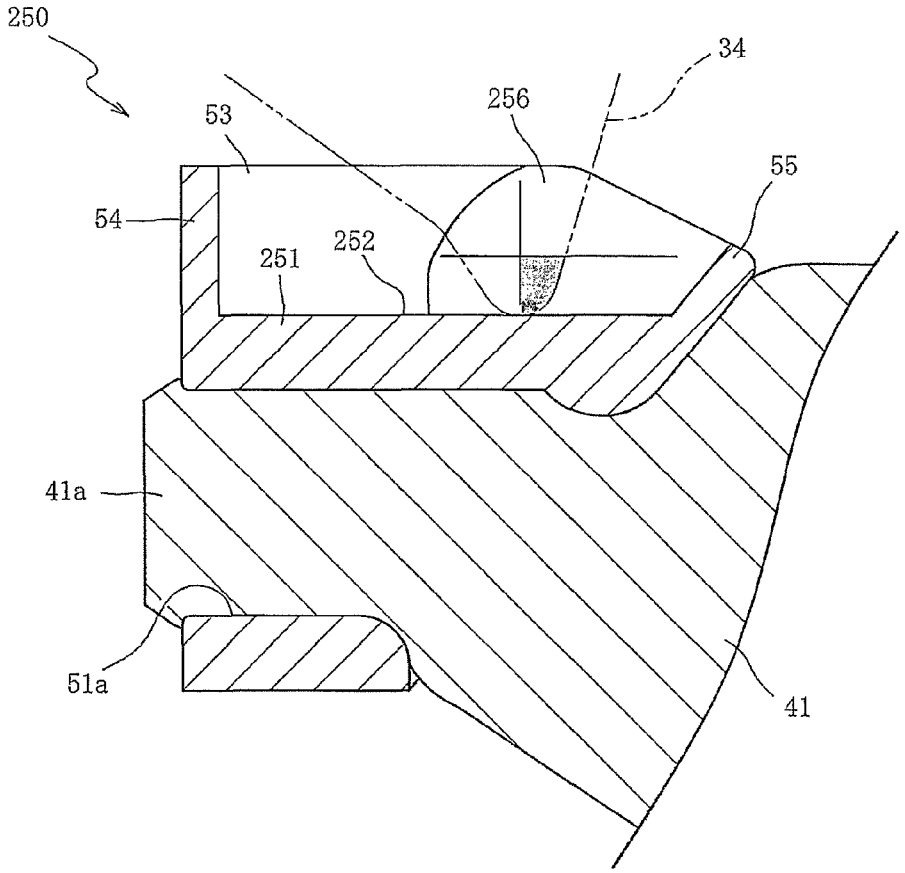
FG.7B

KEYBOARD DEVICE

CROSS-REFERENCE TO RELATED APPLICATIONS

This application claims the priority benefit of Japan application serial no. 2012-213040, filed on Sep. 26, 2012. The entirety of the above-mentioned patent application is hereby incorporated by reference herein and made a part of this specification.

BACKGROUND OF THE INVENTION

1. Field of the Invention

The invention relates to a keyboard device and particularly relates to a keyboard device capable of suppressing noise that occurs upon release of a key.

2. Description of Related Art

Traditionally, in an electronic keyboard instrument, such as an electronic piano, hammers with a specific mass are rotatably pivoted under the keys. The hammer is rotated when the key is pressed or released, so as to give the key a specific action load and reproduce the touching sense of the keys of an acoustic piano.

For instance, a keyboard device is disclosed in Patent Literature 1, which includes: keys rotatably pivoted on a chassis, a protrusion protruding from each key, a sliding surface on which the protrusion slides when a key is pressed or released, and a hammer having one end formed with the sliding surface and the other end provided with a mass body, and a portion of the hammer between said one end and the other end is rotatably pivoted to the chassis. The hammer is rotated along with the pressing or releasing of the key, so as to apply an action load to the key.

In the keyboard device, the sliding surface has an incline surface and a bump portion. When the protrusion slides on the sliding surface along with the pressing of the key, the resistance during the pressing of the key is varied to reproduce the touching sense of the keys of an acoustic piano.

Here, the keyboard device includes a switch to be pressed by the key when the key is pressed, so as to obtain a key pressing information according to the pressing state of the switch. The hammer rotated along with the pressing of the key is rotated in the reverse direction by its deadweight (gravity acting on the mass body) and returns to the initial position. When the hammer returns to the initial position, the pressed key is lifted back to the initial position by the hammer.

PRIOR ART LITERATURE

Patent Literature

[Patent Literature 1] Japanese Patent Publication No. 2012-145728 (paragraphs 0015-0018, FIG. 1 and FIG. 2, etc.)

SUMMARY OF THE INVENTION

Problem to be Solved

However, for the aforementioned keyboard device, the rotation of the key may precede the rotation of the hammer when the key is released. In such a case, the protrusion may depart (jump) from the sliding surface, and noise occurs when the protrusion of the key falls back on (hits) the sliding surface of the hammer. In particular, due to the mechanism that applies a reaction force of the switch to the key, the key begins rotating in the direction back to the initial position relatively fast, and the hammer, which is rotated by its deadweight, is relatively slow. Hence, the key tends to begin rotating earlier than the hammer upon release of the key. Namely, when the key is released, the protrusion easily departs (jumps) from the sliding surface and falls to cause noise.

In view of the aforementioned problems, the invention provides a keyboard device capable of suppressing the noise that occurs upon release of the key.

Solution to the Problem and Effect of the Invention

In a keyboard device of the present embodiment, a protrusion that protrudes from one of a key and a hammer is configured to slide on a sliding surface formed on the other one of the key and the hammer, so as to rotate the hammer along with pressing or releasing of the key and give the key an action load. The key that is pressed to the bottom in a key-pressing direction is lifted by the hammer rotated due to its deadweight and returns to an initial position.

The above keyboard device may include a departure suppressing means for suppressing a relative displacement of the protrusion in a direction away from the sliding surface. Therefore, when the rotation of the key precedes the rotation of the hammer due to some external force, the protrusion can be suppressed from departing from the sliding surface. As a result, the effect of suppressing the noise that occurs when the protrusion falls on (hits) the sliding surface is achieved.

In addition to the effects of the above keyboard device, the keyboard device includes at least one contact portion which is disposed on the other one of the key and the hammer formed with the sliding surface and comprises of a flexible material. The at least one contact portion is in contact with a side surface of the protrusion at least in a state that the key is completely pressed in a key-pressing direction. Therefore, when the key is released, the contact between the at least one contact portion and the side surface of the protrusion suppresses the key from rotating before the hammer, thereby preventing the protrusion from departing from the sliding surface and achieving the effect of suppressing the noise that occurs when the protrusion falls on (hits) the sliding surface.

Moreover, the at least one contact portion, which comprises of a flexible material, may be disposed only in the position that may contact the side surface of the protrusion, such that there is no need to install a complicated movable mechanism, etc., for connecting the key and the hammer. Accordingly, the effect of simplifying the structure for suppressing the key from rotating before the hammer is achieved.

In addition to the effects of the above keyboard device, the at least one contact portion is a pair of contact portions and is disposed in pair and opposite to each other on two sides to clamp a movement track of the protrusion. Since the pair of contact portions contacts the side surface of the protrusion from two sides, the protrusion is clamped by the pair of contact portions and is maintained in a stable state. Hence, the effect of stabilizing the rotation of the key and the hammer is achieved.

In addition to the effects of the above keyboard device, the keyboard device includes a flexible portion which includes a flexible material, and the flexible portion includes the sliding surface and the at least one contact portion that are formed integrally with each other, so as to achieve the effect of preventing the generation of a scratching noise caused by friction when the protrusion slides on the sliding surface. Moreover, since the flexible portion which comprises of a flexible material is used to form the at least one contact portion (namely, the sliding surface and the at least one contact portion are integrated) for preventing the generation of scratching noise, the molds for forming the sliding surface and the at least one contact portion can be integrated to achieve the effect of reducing fabrication costs.

In addition to the effects of the above keyboard device, the sliding surface is disposed under the protrusion, and the flexible portion includes a wall portion disposed upright around the sliding surface and surrounds the sliding surface. When a lubricant, such as grease, etc., is coated to the sliding surface surrounded by the wall portion, the lubricant can be retained on the inner side of the wall portion to prevent the lubricant from flowing out of the sliding surface. Thus, the long-term effect of preventing wearing of the protrusion and the sliding surface and generation of the scratching noise is achieved.

Moreover, the at least one contact portion is a pair of contact portions, disposed on the wall portion that extends along a sliding direction of the protrusion. Therefore, a part of the wall portion, which retains the lubricant, such as grease, etc., can also serve as the at least one contact portion. In comparison with disposing the wall portion and the at least one contact portion separately, the above keyboard device requires less flexible material and can achieve the effect of reducing the material costs.

Furthermore, the pair of contact portions are formed on surfaces of the wall portion which face the side surface of the protrusion. The space formed between the wall portion for retaining the lubricant, such as grease, etc., can also be used for disposing the contact portions (using the deadspace effectively) to utilize the space more effectively and achieve the effect of miniaturization.

In addition to the effects of the above keyboard device, the at least one contact portion is formed in continuation with the sliding surface. Therefore, an opening side of the wall portion that surrounds the sliding surface can be a die-cutting direction of the mold that is used for forming the flexible portion. Since undercut does not occur between the sliding surface and the at least one contact portion, forced extraction can be avoided and the effect of maintaining the formability of the flexible portion can be assured.

In addition to the effects of the above keyboard device, the sliding surface includes a first surface which is a flat or curved surface inclined towards a direction that is along the sliding direction of the protrusion during the pressing of the key and departs from a base portion of the protrusion, and a bump portion which is formed in continuation with the first surface and rises up towards a direction that is along the sliding direction of the protrusion during the pressing of the key and approaches the base portion of the protrusion. Hence, after the protrusion slides through the first surface and arrives at the bump portion, a variation in the sense of resistance is increased when the protrusion crosses over the bump portion for the player to recognize that there is a large variation in the sense of resistance before and after the bump portion. As a result, the effect of reproducing the touching sense of the keys of an acoustic piano (clicking sense) is achieved.

In addition to the effects of the above keyboard device, a gap is formed between the side surface of the protrusion and the at least one contact portion at least when the protrusion slides on the first surface and the bump portion. Accordingly, when the protrusion slides through the first surface and crosses over the bump portion during the pressing of the key, or when the protrusion crosses over the bump portion and slides through the first surface during the releasing of the key, the contact between the side surface of the protrusion and the at least one contact portion is avoided to prevent the heavy touching sense of the key. As a result, this configuration does not cause adverse influence to the simulated key touching sense (clicking sense) of an acoustic piano and can suppress the protrusion from departing from the sliding surface during the releasing of the key, so as to achieve the effect of suppressing the generation of noise that occurs when the protrusion falls on (hits) the sliding surface.

In addition to the effects of the above keyboard device, the at least one contact portion include a plurality of convex portions which protrude from the surfaces that contact the protrusion. The convex portions can achieve close contact when the at least one contact portion are in contact with the side surface of the protrusion. Particularly, in the case of using a lubricant such as grease, etc., if the at least one contact portion has a smooth surface, the contact pressure is low and may cause the at least one contact portion to slip on the side surface of the protrusion easily. Due to the close contact achieved by the convex portions, the contact pressure of the convex portions can be increased to maintain the friction. Since the at least one contact portion is in close contact with the side surface of the protrusion and do not slip easily, the key is suppressed from rotating before the hammer. As a result, the protrusion can be prevented from departing from the sliding surface to achieve the effect of suppressing the generation of noise that occurs when the protrusion falls on (hits) the sliding surface.

Moreover, the convex portions may be in the form of protrusions that protrude partially from the surrounding or in the form of ribs that protrude from the surrounding and are continuous only for a specific length. For example, a cross section of the convex portion along an axis orthogonal to the protrusion direction may be a circular or elliptic tapered protrusion, a polygonal tapered protrusion, or a semi-spherically protruding protrusion; or, the convex can be an embossed pattern formed on the contact surfaces such as a protrusion of rock texture, sand texture, crepe, or geometric pattern, etc.

In addition to the effects of the above keyboard device, the keyboard device includes an engagement element that protrudes from the protrusion, and a guiding slot into which the engagement element is movably inserted and is formed on the other one of the key and the hammer formed with the sliding surface. The guiding slot extends along a track that the engagement element moves when the protrusion slides on the sliding surface during the pressing of the key. Since the engagement element of the protrusion is engaged with the inner surface of the guiding slot, it is possible to prevent the protrusion from departing further from the sliding surface when the rotation of the key precedes the rotation of the hammer upon releasing of the key and causes the protrusion to depart or almost depart from the sliding surface. In other words, the engagement between the engagement element of the protrusion and the inner surface of the guiding slot can prevent the key from rotating before the hammer, so as to suppress the departure of the protrusion or the degree of the departure and achieve the effect of suppressing the generation of noise that occurs when the protrusion falls on (hits) the sliding surface.

In addition to the effects of the above keyboard device, the engagement element is in contact with the inner surface of the guiding slot at least in a state that the key is completely pressed in the key-pressing direction. Hence, when the player's hand releases the key from the key-pressing state, the key is suppressed from rotating before the hammer to prevent the protrusion from departing from the sliding surface, thereby achieving the effect of suppressing the generation of noise that occurs when the protrusion falls on (hits) the sliding surface.

In addition to the effects of the above keyboard device, the keyboard device includes a flexible portion which includes a flexible material, and the flexible portion includes the sliding surface and the guiding slot that are formed integrally with each other, so as to achieve the effect of preventing the generation of scratching noise caused by friction when the protrusion slides on the sliding surface. Moreover, since the flexible portion which comprises a flexible material is used to form the guiding slot (namely, the sliding surface and the guiding slot are integrated) for preventing the generation of scratching noise, the molds for forming the sliding surface and the guiding slot can be integrated to achieve the effect of reducing fabrication costs.

In addition to the effects of the above keyboard device, the sliding surface includes a first surface which is a flat or curved surface inclined towards a direction that is along the sliding direction of the protrusion during the pressing of the key and departs from a base portion of the protrusion, and a bump portion which is formed in continuation with the first surface and rises up towards a direction that is along the sliding direction of the protrusion during the pressing of the key and approaches the base portion of the protrusion. Hence, after the protrusion slides through the first surface and arrives at the bump portion, a variation in the sense of resistance is increased when the protrusion crosses over the bump portion for the player to recognize that there is a large variation in the sense of resistance before and after the bump portion. As a result, the effect of reproducing the touching sense of the keys of an acoustic piano (clicking sense) is achieved.

In addition to the effects of the above keyboard device, a gap is formed between the inner surface of the guiding slot and the engagement element of the protrusion at least when the protrusion slides on the first surface and the bump portion. Accordingly, when the protrusion slides through the first surface and crosses over the bump portion during the pressing of the key, or when the protrusion crosses over the bump portion and slides through the first surface during the releasing of the key, the contact between the inner surface of the guiding slot and the engagement element of the protrusion is avoided to prevent the heavy touching sense of the key. As a result, this configuration does not cause adverse influence to the simulated key touching sense (clicking sense) of an acoustic piano and can suppress the protrusion from departing from the sliding surface during the releasing of the key, so as to achieve the effect of suppressing the generation of noise that occurs when the protrusion falls on (hits) the sliding surface.

BRIEF DESCRIPTION OF THE DRAWINGS

FIG. 5B is a schematic cross-sectional view of the receiving portion along the line Vb-Vb of FIG. 4B.

FIG. 7A is a schematic top view of a receiving portion according to the second embodiment.

FIG. 7B is a schematic cross-sectional view of the receiving portion along the line VIIb-VIIb of FIG. 7A.

DESCRIPTION OF THE EMBODIMENTS

Figure 1:
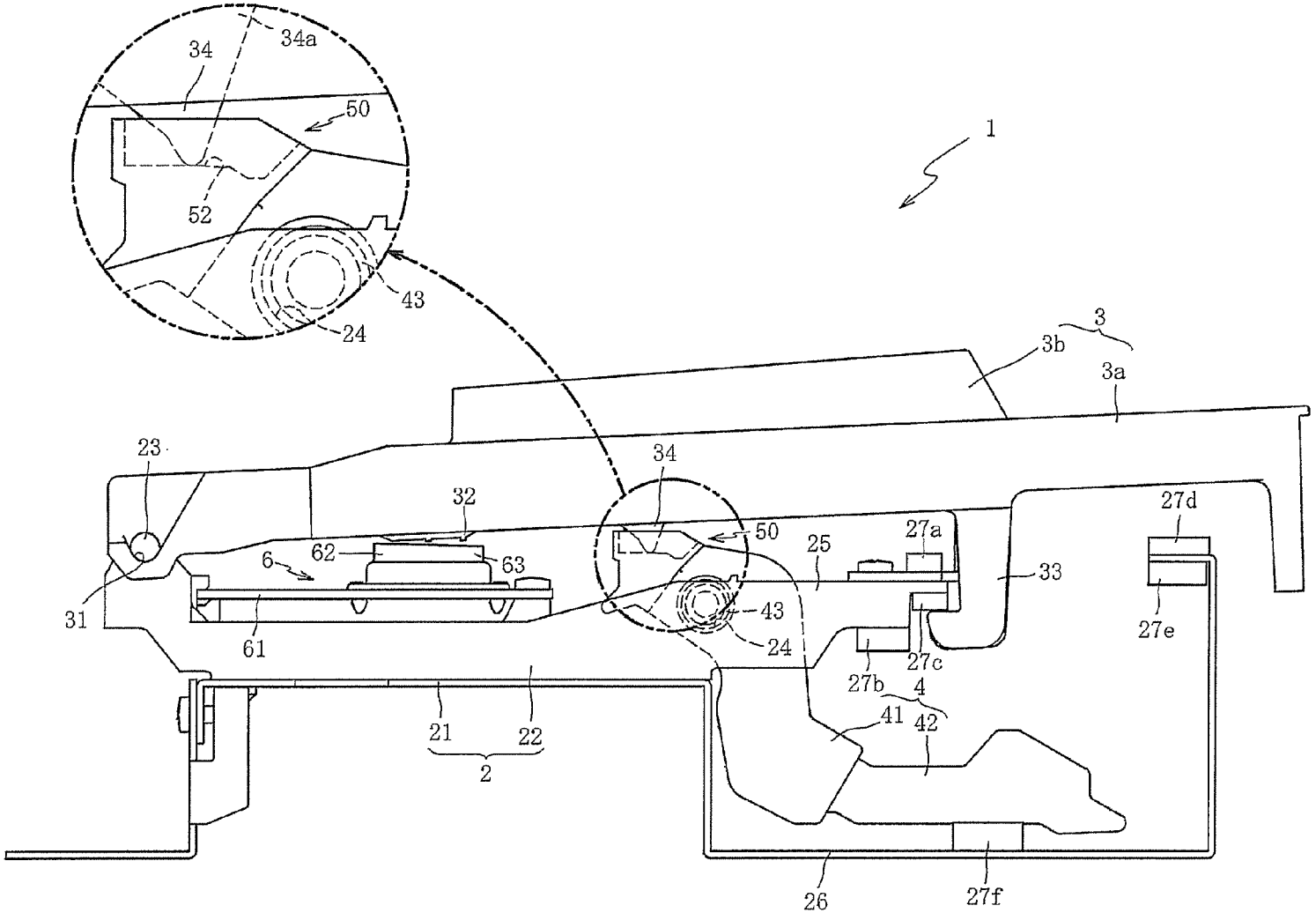
FIG. 1 is a schematic lateral view of a keyboard device according to the first embodiment and illustrates an initial state thereof.
Figure 2:
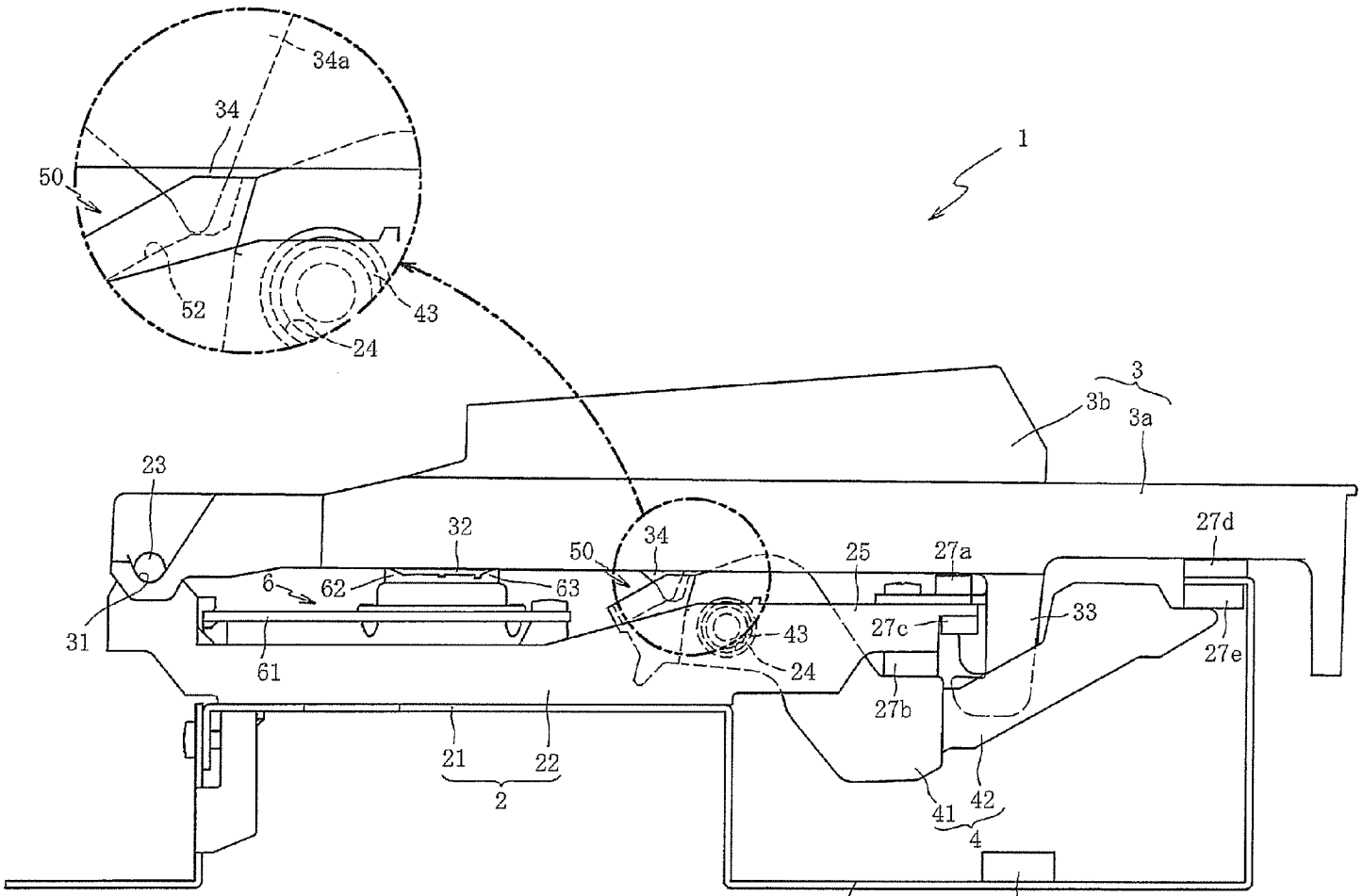
FIG. 2 is a schematic lateral view of the keyboard device and illustrates a key-pressing state thereof.

Exemplary embodiments of the invention are provided in the following paragraphs with reference to the affixed figures. First, a keyboard device 1 of the first embodiment of the invention is described with reference to FIG. 1 to FIGS. 6A, 6B, 6C. FIG. 1 and FIG. 2 are schematic lateral views of the keyboard device 1 of the first embodiment, wherein FIG. 1 illustrates a state of the key being released, namely an initial state, and FIG. 2 illustrates a state of the key being pressed, namely a key-pressing state.

A left-right direction of the keyboard device 1 is defined according to an observation direction of a player when the keyboard device 1 is applied to an electronic keyboard apparatus (not shown), and regarding a front-back direction of the keyboard device 1, a player side of the keyboard device 1 is regarded as the "front" when the keyboard device 1 is applied to the electronic keyboard apparatus (not shown).

Below, a position of a key 3 in the initial state shown in FIG. 1 is called an "initial position" and a position of the key 3 in the key-pressing state (namely, the state that the key 3 is pressed to the bottom in a key-pressing direction) shown in FIG. 2 is called a "key-pressing position."

As shown in FIG. 1 and FIG. 2, the keyboard device 1 serves as a keyboard operation part of the player and is used for detecting an operating state of the key 3, and the keyboard device 1 is suitable for applying to an electronic keyboard instrument (not shown) such as an electronic piano, etc. The keyboard device 1 mainly includes the following parts: a chassis 2, which is formed by using a synthetic resin material or a steel plate, etc.; a plurality of keys 3 (for example, 88), which are rotatably supported by the chassis 2 and are constructed with white keys 3*a* and black keys 3*b*; and a hammer 4, which is provided to each of the keys 3 and rotates along with a key-pressing operation or a key-releasing operation of the key 3.

The keys 3 (the white keys 3*a* and the black keys 3*b*) are disposed on an upper surface (upper side of FIG. 1 and FIG. 2) of the chassis 2, and the hammers 4 are respectively disposed corresponding to the keys 3 and located inside the chassis 2, and the hammers 4 are arranged along a left-right direction (a direction vertical to a page surface of FIG. 1) of the chassis 2. Moreover, regarding the mechanism for rotating the hammer 4 along with the key-pressing operation or the key-releasing operation, the same mechanism is applied for both the white key 3*a* and the black key 3*b*; therefore, in following disclosure, the white key 3*a* is used as an example for description, and the disclosure of the black key 3*b* is omitted.

The chassis 2 is a member which forms a framework of the keyboard device 1, and the chassis 2 includes a chassis body 21 and a chassis enhancement member 22 fixed on an upper surface of the chassis body 21. The chassis enhancement member 22 has a key supporting protrusion 23 at a rear end thereof (left side of FIG. 1 and FIG. 2). The key supporting protrusion 23 is formed for each of the keys 3 and used for rotatably supporting each of the keys 3. A supporting hole 31 formed in a sidewall part of the key 3 is engaged with the key supporting protrusion 23, and the key 3 is rotatably pivoted on (supported by) the chassis 2.

Hammer supporting recesses 24 are locations for rotatably supporting the hammers 4. The hammer supporting recesses 24 are formed approximately at a central portion of the chassis 2 and are formed in recession at two sidewalls of an opening portion (not shown) formed by a front end of the chassis enhancement member 22 for each of the hammers 4. Hammer supporting protrusions 43 formed at two sidewalls of the hammer 4 are engaged with the hammer supporting recesses 24, and the hammer 4 is rotatably pivoted on (supported by) the chassis 2. Moreover, the opening portion has a size suitable for float plugging the hammer 4, so that the hammer 4 can be rotated at the front end of the chassis enhancement member 22.

On the upper surface of the chassis enhancement member 22 between the key supporting protrusion 23 and the hammer supporting recesses 24, a key switch 6 used for detecting key-pressing information of the key 3 is installed. The key switch 6 has a circuit board 61 screw-locked to the chassis enhancement member 22, and a first switch 62 and a second switch 63, which are rubber switches, are disposed on an upper surface of the circuit board 61. When the first switch 62 and the second switch 63 are sequentially pressed by a switch pressing part 32 of the key 3 and turned on, the key-pressing information (velocity) of the key 3 is detected according to a time difference of the ON-operations of the switches 62 and 63.

An upper extending portion 25 is an approximately horizontal extending portion which extends from the chassis enhancement member 22 towards the front end (right side of FIG. 1 and FIG. 2). When the key 3 is released, the upper extending portion 25 leans against a stopper portion 33 of the key 3 to confine an upper limit position of the key 3 (see FIG. 1), and when the key 3 is pressed, the upper extending portion 25 leans against a lower surface of the key 3 and an upper surface of the hammer 4 to respectively confine a lower limit position of the key 3 and an upper limit position of the hammer 4 (see FIG. 2).

A lower extending portion 26 is disposed under and in front of (on the right side of FIG. 1 and FIG. 2) the upper extending portion 25. The lower extending portion 26 extends from the chassis body 21 to the front side and approximately presents a U-shape when viewed from a lateral view. When the key 3 is released, the lower extending portion 26 leans against a lower surface of the hammer 4 to confine a lower limit position of the hammer 4 (see FIG. 1), and when the key 3 is pressed, the lower extending portion 26 leans against the lower surface of the key 3 and the upper surface of the hammer 4 to confine the lower limit position of the key 3 and the upper limit position of the hammer 4 (see FIG. 2).

A cushion material 27*a* is disposed on an upper surface of the upper extending portion 25, and cushion materials 27*b* and 27*c* are disposed on a lower surface of the upper extending portion 25. Moreover, a cushion material 27*d* is disposed on an upper surface of a top end of the lower extending portion 26, a cushion material 27*e* is disposed on a lower surface of the top end of the lower extending portion 26, and a cushion material 27*f* is disposed on an upper surface of a bottom portion of the lower extending portion 26. The cushion materials 27*a*-27*f* are used for cushioning or muffling, which are, for example, made of felt or urethane foam, etc. to absorb the impact generated during a process of confining the rotation of the key 3 or the hammer 4.

The key 3 is a bar-shaped member, made of a synthetic resin and having a U-shaped cross section opened towards the bottom side (lower side of FIG. 1 and FIG. 2), and is disposed on the upper surface of the chassis 2. The supporting hole 31 thereon is engaged with the key supporting protrusion 23, so that the key 3 is rotatably supported by the chassis 2. The key 3 has the stopper portion 33, which extends downwards from the sidewall of the key 3 and presents an L-shape when observed from the lateral view. As described above, the stopper portion 33 leans against the upper extending portion 25 (the cushion material 27*c*) of the chassis 2, so that the upper limit position of the key 3 is confined when the key 3 is released (see FIG. 1).

In addition, the key 3 is formed with a protrusion 34 extending downwards from the bottom surface and roughly presenting a tapered-shape, and the protrusion 34 leans against a back end of the hammer 4. In the case of the key-releasing operation, the key 3 is lifted to the initial position, as shown in FIG. 1, through a mass of the hammer 4, and in the key-pressing operation, a specific touch weight is provided to the key 3 through the mass of the hammer 4.

When the switch pressing part 32 presses the first switch 62 and the second switch 63 in the key-pressing operation of the key 3, the switches 62 and 63 generate a reaction force (elastic recovery force) that lifts the key 3 back to the initial position shown in FIG. 1. The reaction force of the first switch 62 and the second switch 63 increases with the pressing of the key 3. In the key-pressing state (the state that the key 3 is pressed to the bottom in the key-pressing direction) shown in FIG. 2, the key 3 receives the maximum reaction force from the switches 62 and 63.

The hammer 4 is rotated along with the key-pressing operation or the key-releasing operation of the key 3, so as to provide a touch weight the same as that of an acoustic piano. The hammer 4 mainly includes a hammer body 41 made of a synthetic resin, such as POM (Polyoxymethylene), etc., and a mass body 42, which is connected to the hammer body 41 to function as a weight.

The hammer supporting protrusions 43 serve as a rotation shaft rotatably supporting the hammer 4, and are configured at two sidewalls of a back end (the left side of FIG. 1 and FIG. 2) of the hammer body 41. The hammer supporting protrusions 43 are engaged with the hammer supporting recesses 24, and the hammer 4 is rotatably supported by the chassis 2. Since the mass body 42 is located prior to (the right side of FIG. 1 and FIG. 2) the hammer supporting protrusions 43, the hammer 4 is provided with energy along a clockwise direction of FIG. 1 due to a deadweight of the mass body 42.

Here, a receiving portion 50 is installed at the back end of the hammer body 41, and a sliding surface 52 is formed on an upper surface of the receiving portion 50 along a front-back direction (the left-right direction of FIG. 1 and FIG. 2) of the hammer 4. The protrusion 34 protruding downwards from the bottom surface of the key 3 leans against the sliding surface 52 of the receiving portion 50.

When the key 3 is pressed away from the initial position shown in FIG. 1, the key 3 is rotated with the key supporting protrusion 23 as the center along the clockwise direction of FIG. 1, and the receiving portion 50 is pressed downwards by the protrusion 34 to rotate the hammer 4 with the hammer supporting protrusion 43 as the center along an anticlockwise direction of FIG. 1. In this way, the protrusion 34 slides on the sliding surface 52.

In addition, when the key 3 is released from the key-pressing position of FIG. 2, the hammer 4 is rotated with the hammer supporting protrusion 43 as the center along the clockwise direction of FIG. 2 due to its deadweight (gravity acting on the mass body 42), and the protrusion 34 is lifted upwards by the receiving portion 50 to rotate the key 3 with the key supporting protrusion 23 as the center along the anticlockwise direction of FIG. 2.

Here, as described above, the key 3 is also pushed upwards by the reaction force of the first switch 62 and the second switch 63. Therefore, the rotation of the key 3, on which the reaction force is applied, precedes the rotation of the hammer 4, and when the protrusion 34 departs (jumps) and falls on (hits) the sliding surface 52, noise (a stroke sound) occurs. If the reaction force of the switches 62 and 63 is reduced, the noise is suppressed, but consequently the contact resistance cannot provide the desired characteristics and the key-pressing information cannot be detected accurately. Moreover, chattering may also occur. In this exemplary embodiment, the receiving portion 50 is provided with contact portions 56 for suppressing the generation of noise without unnecessarily reducing the reaction force of the switches 62 and 63. Below, the structure of the receiving portion 50 is described with reference to FIG. 3 to FIGS. 5A, 5B.

Figure 3:
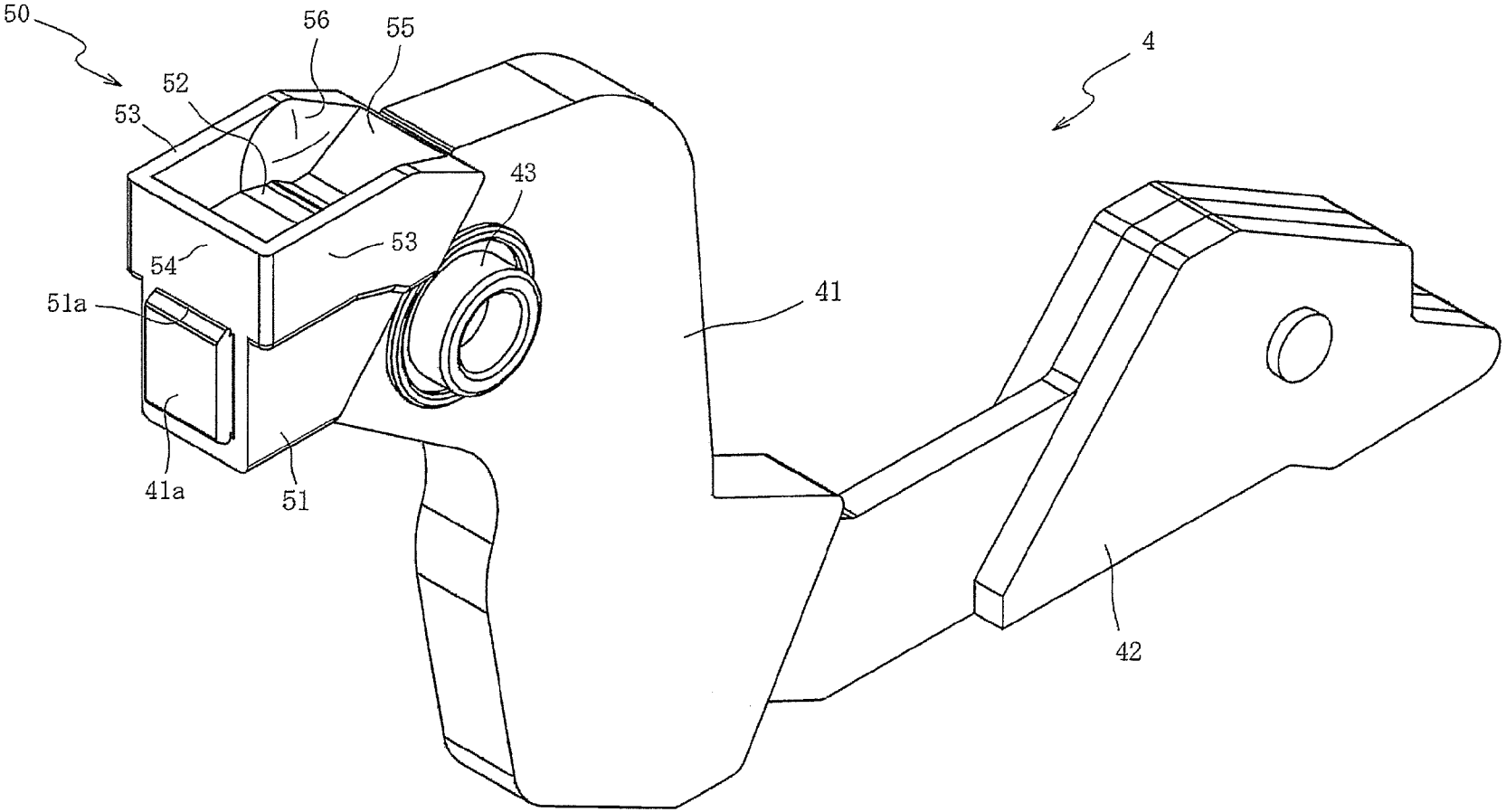
FIG. 3 is a schematic perspective view of a hammer.

FIG. 3 is a schematic perspective view of the hammer 4. As illustrated in FIG. 3, a connection portion 41*a* having a rectangular cross section is formed integrally with the hammer body 41 of the hammer 4 and protrudes at the rear end (left side of FIG. 3). By inserting the connection portion 41*a* of the hammer body 41 into an insertion hole 51*a* of the receiving portion 50, the receiving portion 50 is installed to the rear end of the hammer 4 with the sliding surface 52 facing upwards.

Figure 4A:
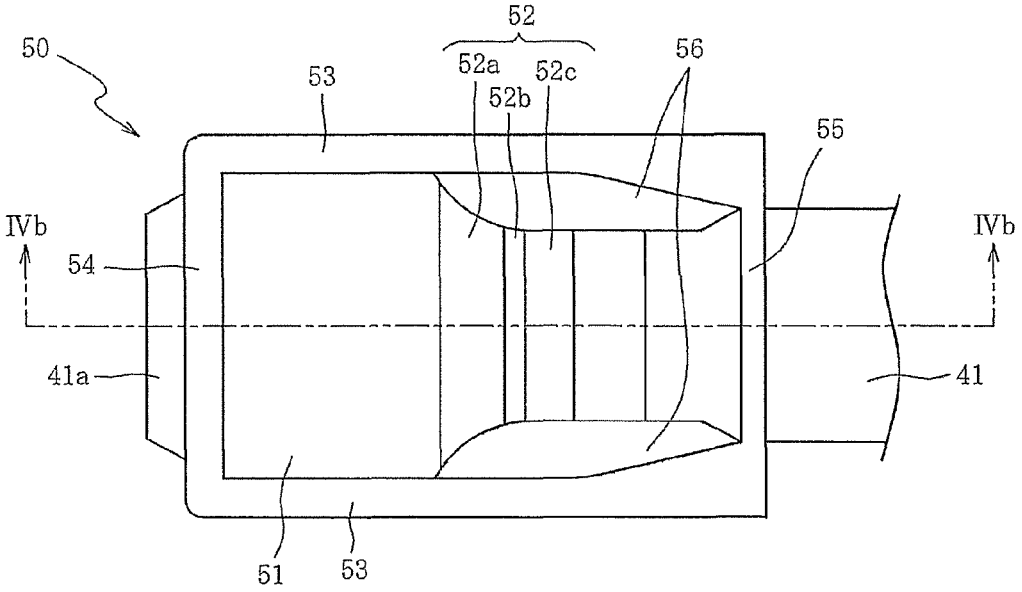
FIG. 4A is a schematic top view of a receiving portion.
Figure 4B:
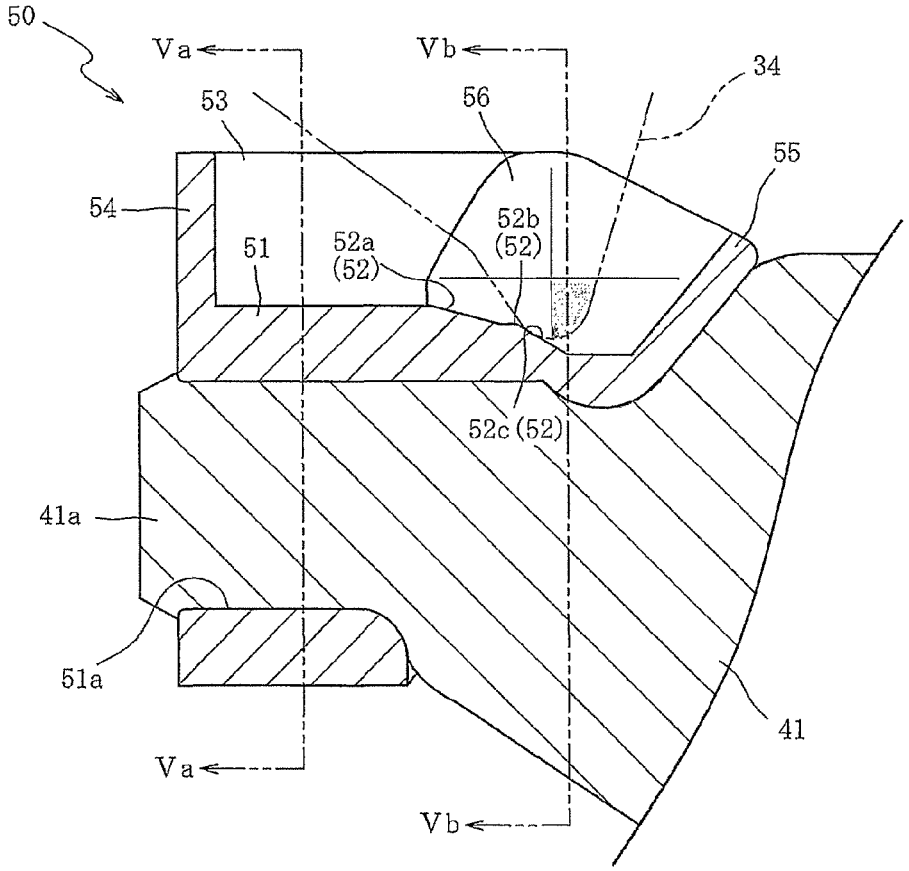
FIG. 4B is a schematic cross-sectional view of the receiving portion along the line IVb-IVb of FIG. 4A.
Figure 5A:
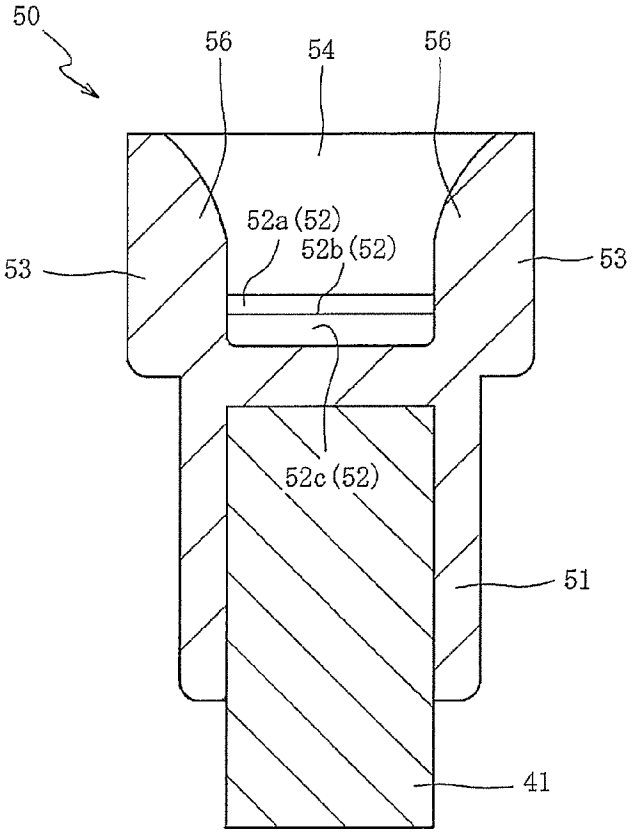
FIG. 5A is a schematic cross-sectional view of the receiving portion along the line Va-Va of FIG. 4B.
Figure 5A:
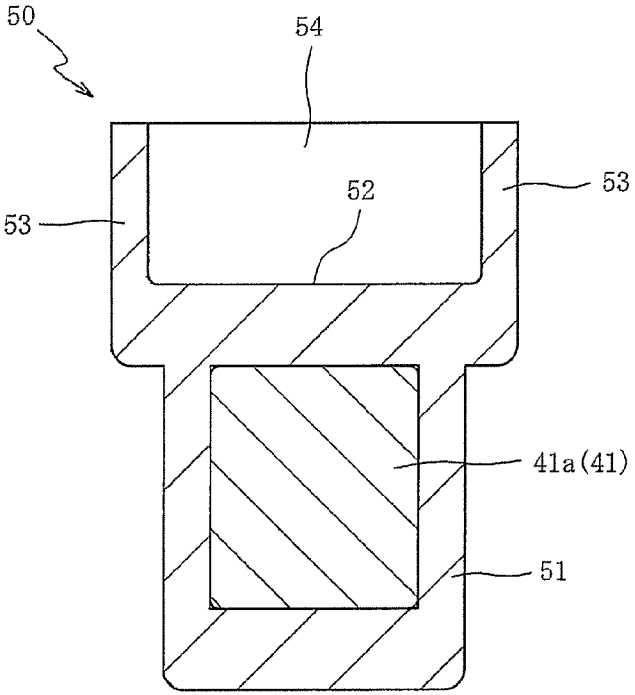

FIG. 4A is a schematic top view of the receiving portion 50. FIG. 4B is a schematic cross-sectional view of the receiving portion 50 along the line IVb-IVb of FIG. 4A. FIG. 5A is a schematic cross-sectional view of the receiving portion 50 along the line Va-Va of FIG. 4B. FIG. 5B is a schematic cross-sectional view of the receiving portion 50 along the line Vb-Vb of FIG. 4B. In FIG. 4B, a position of the protrusion 34 in the key-pressing state is represented by a two-dot chain line.

As illustrated in FIGS. 4A, 4B and FIGS. 5A, 5B, the receiving portion 50 includes: a receiving body portion 51 formed with the insertion hole 51*a* and having the sliding surface 52 thereon, wall portions 53-55 disposed upright to surround the sliding surface 52 of the receiving body portion 51, and the contact portions 56 protruding from opposite surfaces of the pair of wall portions 53, which face to each other. These components of the receiving portion 50 are formed integrally with each other using a flexible material.

The flexible material is a rubber material, such as silicone rubber, etc., or thermoplastic elastomer, etc., for example. Moreover, an area of the receiving portion 50, which is surrounded by the wall portions 53-55, is filled with a lubricant such as grease, etc. As a result, wearing or scratching noise that occurs when the protrusion 34 slides on the sliding surface 52 is prevented.

The sliding surface 52 is a surface on which the protrusion 34 slides along an orthogonal direction (the left-right direction of FIG. 4A and FIG. 4B) of an axial direction of the hammer supporting protrusion 43 (see FIG. 1 or FIG. 2) in the key-pressing operation or the key-releasing operation.

In this exemplary embodiment, the sliding surface 52 includes: a first surface 52*a* that is inclined towards a direction, which is along a sliding direction (from the left to the right of FIG. 4A and FIG. 4B) of the protrusion 34 in the key-pressing operation and gradually departs from a base portion 34*a* of the protrusion 34 (see FIG. 1 and FIG. 2); a bump portion 52*b* that is formed in continuation with the first surface 52*a* and rises up towards a direction, which is along the sliding direction of the protrusion 34 in the key-pressing operation and approaches the base portion 34*a* of the protrusion 34; and a second surface 52*c*, which is formed in continuation with the bump portion 52*b* and is an area that the protrusion 34 slides until the key 3 arrives at the key-pressing position of FIG. 2 (namely, the key 3 is pressed to the bottom in the key-pressing direction) after the protrusion 34 crosses over the bump portion 52*b*.

After the protrusion 34 slides through the first surface 52*a* and arrives at the bump portion 52*b* in the key-pressing operation, a variation in the sense of resistance is increased when the protrusion 34 crosses over the bump portion, such that the player can recognize that there is a large variation in the sense of resistance before and after the bump portion 52*b*. As a result, the touching sense of the keys of an acoustic piano (clicking sense) can be reproduced.

The wall portions 53 are extended in the sliding direction, along which the protrusion 34 slides on the sliding surface 52, and are arranged in pair and opposite to each other with a specific interval therebetween. The pair of wall portions 53 is connected with the wall portions 54 and 55 respectively at one end and the other end thereof in the extending direction (the left side and right side of FIG. 4A and FIG. 4B).

The contact portions 56 are in contact with the side surfaces of the protrusion 34 at least when the key 3 arrives at the key-pressing position of FIG. 2 (the key being pressed to the bottom in the key-pressing direction). The contact portions 56 are respectively formed on the opposite surfaces of the wall portions 53 and connected with the sliding surface 52.

As described above, because the receiving portion 50 is made of a flexible material, the generation of scratching noise caused by friction when the protrusion 34 slides on the sliding surface 52 can be prevented. In this case, since the receiving portion 50 made of a flexible material is used to form the contact portions 56 (namely, the sliding surface 52 and the contact portions 56 are formed integrally with each other) for preventing the scratching noise, the molds for forming the sliding surface 52 and the contact portions 56 can be integrated. It is not necessary to fabricate these parts separately, and thus the fabrication costs can be reduced.

Moreover, because the contact portions 56 are disposed on the opposite surfaces of the wall portions 53 (surfaces facing side surfaces of the protrusion 34) and connected with the sliding surface 52, an opening side (e.g. the upper side of FIG. 4B) of the wall portions 53-55 that surround the sliding surface 52 can be a die-cutting direction of the mold that is used for forming the receiving portion 50. Namely, undercut does not occur between the sliding surface 52 and the contact portions 56. Therefore, forced extraction can be avoided and the formability of the receiving portion 50 can be assured.

Regarding the receiving portion 50, since the wall portions 53-55 are disposed upright around the sliding surface 52 to surround the sliding surface 52, when the lubricant, such as grease, etc., is coated to the sliding surface 52, the lubricant can be retained on the inner side of the wall portions 53-55 to prevent the lubricant from flowing out of the sliding surface 52. Accordingly, a long-term effect of preventing wearing of the protrusion 34 or the sliding surface 52 and generation of the scratching noise is achieved.

In this way, the contact portions 56 are disposed on a part (wall portions 53) of the wall portions 53-55 configured for retaining the lubricant material, and the wall portions 53 that retain the lubricant material can serve as the contact portions 56. In comparison with disposing the wall portions 53 and the contact portions 56 separately, this exemplary embodiment requires less flexible material and can achieve reduction of the material costs.

In addition, because the contact portions 56 are disposed on the opposite surfaces of the wall portions 53 (surfaces facing side surfaces of the protrusion 34), the space surrounded by the wall portions 53-55 for retaining the lubricant, such as grease, etc., can also be utilized for disposing the contact portions 56 (that is, using the deadspace effectively) to use the space effectively, thereby achieving miniaturization of the receiving portion 50.

Referring to the top-view shape of the contact portions 56 illustrated in FIG. 4A, the contact portions 56 are respectively formed with a curved portion located on the side of the wall portion 54 and having a convex arc shape that curves inward, wherein an opposing interval between the curved portions (interval in the top-bottom direction of FIG. 4A) gets narrower along the sliding direction of the protrusion 34 in the key-pressing operation; and a straight portion formed in continuation with the curved portion and having a straight shape parallel to the sliding direction of the protrusion 34, wherein the opposing interval between the straight portions remains the same along the sliding direction of the protrusion 34 in the key-pressing operation.

Referring to the cross-section shape on a plane orthogonal to the sliding direction of the protrusion 34, as shown in FIG. 5B, the opposing interval between the curved portions and the straight portions is fixed for a part of the contact portions 56 on the side of the sliding surface 52 in the top-bottom direction (the top-bottom direction of FIG. 2B), and gradually increases towards the top opening for the rest of the contact portions (the top side of FIG. 5A).

Regarding the contact portions 56, the opposing interval (interval in the top-bottom direction of FIG. 4A and interval in the left-right direction of FIG. 5B) between the parts that have a straight shape (called "contact part" hereinafter) on the side of the sliding surface 52 in the cross-section shape of FIG. 5B, which is within the straight portions having a straight shape in the top-view shape of FIG. 4A, is smaller than the thickness (in a direction vertical to a page surface of FIG. 4A) of the protrusion 34. The opposing interval between parts that are closer to the side of the wall portion 54 (the left side of FIG. 4A) than the contact parts and between parts on the top (the upper side of FIG. 5B) is larger than the thickness of the protrusion 34.

Here, multiple convex portions (not shown) are disposed in protrusion at least on outer surfaces of the contact parts within the outer surfaces of the contact portions 56, so as to achieve close contact when the side surfaces of the protrusion 34 contact the contact parts of the contact portions 56. Particularly, in the case of using a lubricant such as grease, etc., if the outer surfaces of the contact parts of the contact portions 56 are smooth, the contact pressure is low and may cause the side surfaces of the protrusion 34 to slip. Due to the close contact achieved by the convex portions, the contact pressure of the convex portions is increased to maintain the friction. Thus, the contact parts of the contact portions 56 are in close contact with the side surfaces of the protrusion 34 to prevent slip, thereby suppressing the key 3 from rotating before the hammer 4. As a result, the protrusion 34 can be prevented from departing from the sliding surface 52 to suppress the generation of noise that occurs when the protrusion 34 falls on (hits) the sliding surface 52.

When the key 3 is in the initial position of FIG. 1, there is a gap between the side surfaces of the protrusion 34 and the contact portions 56 (that is, the contact portions 56 are not in contact with the side surfaces of the protrusion 34). When the protrusion 34 crosses over the bump portion 52*b* of the sliding surface 52 and arrives at the second surface 52*c* in the key-pressing operation, the side surfaces of the protrusion 34 come into contact with a part of the contact parts of the contact portions and the side surfaces at the front end of the protrusion 34 are contacted (clamped) by the contact parts of the contact portions 56 on two sides.

When the protrusion 34 slides further on the second surface 52*c* in the key-pressing operation, the contact area between the side surfaces of the protrusion 34 and the contact parts of the contact portions 56 gradually increases and reaches the maximum when the key 3 arrives at the key-pressing position of FIG. 2 (being pressed to the bottom in the key-pressing direction). FIG. 4B illustrates a situation that the key 3 is in the key-pressing position of FIG. 2, and the contact area between the contact parts of the contact portions 56 and the side surfaces of the protrusion 34 is represented by hatching for easy understanding.

The contact portions 56 are configured to contact the side surfaces of the protrusion 34 that slides on the second surface 52*c*, and the second surface 52*c* is the area that the protrusion 34 slides until the key 3 arrives at the key-pressing position of FIG. 2 (the key 3 is pressed to the bottom in the key-pressing direction) after the protrusion 34 crosses over the bump portion 52*b*. Accordingly, when the protrusion 34 slides through the first surface 52*a* and crosses over the bump portion 52*b* in the key-pressing operation, or when the protrusion 34 crosses over the bump portion 52*b* and slides through the first surface 52*a* in the key-releasing operation, the contact between the side surfaces of the protrusion 34 and the contact portions 56 is avoided to prevent the heavy touching sense of the key 3. As a result, such a configuration does not cause adverse influence to the simulated key touching sense (clicking sense) of an acoustic piano and can suppress the protrusion 34 from departing from the sliding surface 52 during key release, so as to suppress the generation of noise that occurs when the protrusion 34 falls on (hits) the sliding surface 52.

The curved portions of the contact portions 56 that are formed in continuation with the straight portions on the side of the wall portion 54 are curved into an arc shape as shown in FIG. 4A, and the portions on the top side are also curved into an arc shape shown in FIG. 5B. In other words, with the exception of the contact parts, the opposing interval increases as departing from the contact parts. Hence, when the protrusion 34 that slides on the sliding surface 52 is inserted between the contact parts of the contact portions 56, the contact portions 56 can be elastically-deformed gradually with the insertion to suppress the variation in touch of the key 3.

In this case, even if the relative positions of the contact portions 56 and the protrusion 34 shift due to dimensional tolerance or operational variation, the protrusion 34 can still be guided to the contact parts of the contact portions 56 smoothly. Moreover, in the case that the protrusion 34 departs from the sliding surface 52 and falls on (hits) the sliding surface 52 in the key-releasing operation, since the area that the protrusion 34 falls is formed with the contact portions 56, the protrusion 34 can be smoothly received between the contact portions 56, and the impact of falling is moderated to suppress the generation of noise.

Figure 6A:
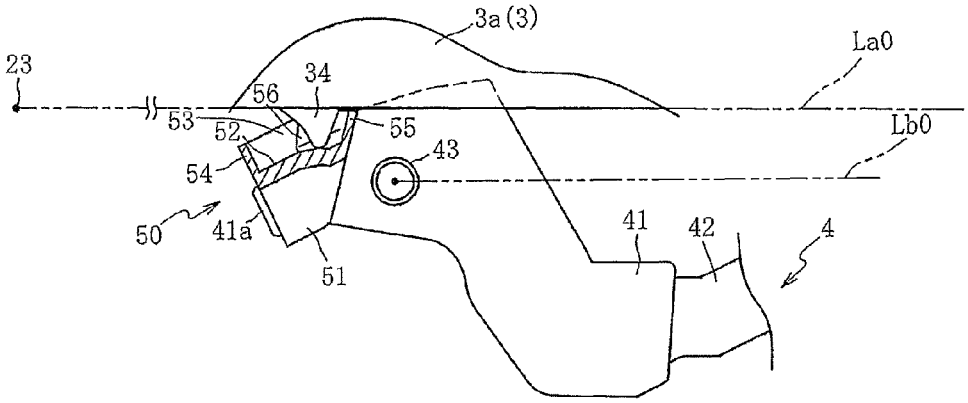
FIG. 6A is a partially-enlarged lateral view of a key and the hammer in the key-pressing state.
Figure 6B:
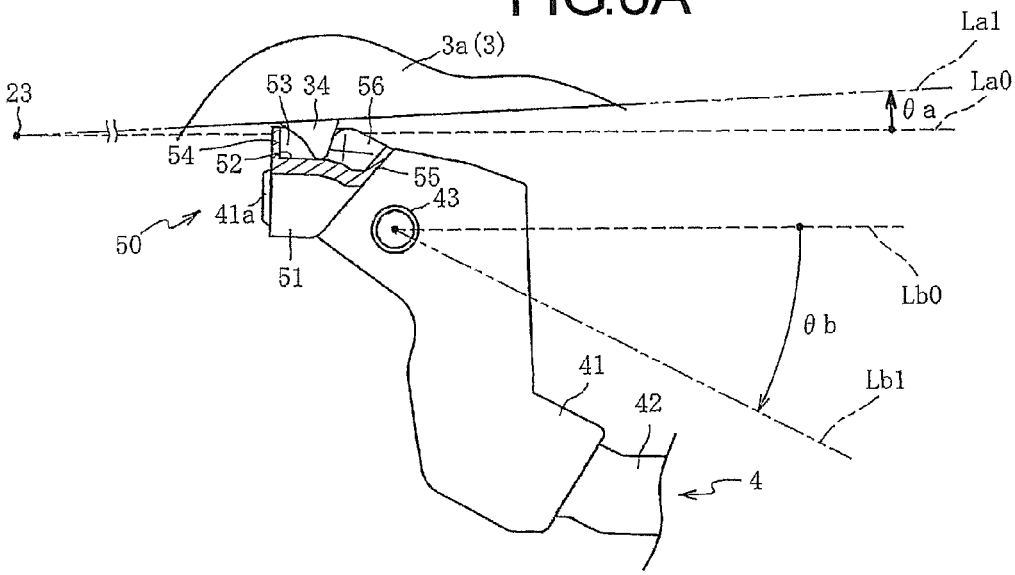
FIG. 6B is a partially-enlarged lateral view of the key and the hammer in the initial state.
Figure 6C:
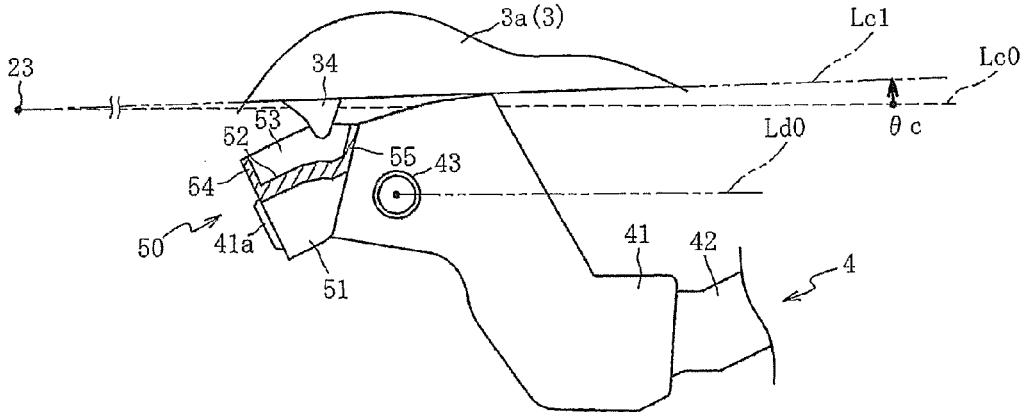
FIG.6C(Related Art)
FIG. 6C is a partially-enlarged lateral view of the key and the hammer in a conventional keyboard device that includes no contact portion.

Next, a noise-proof function provided by the contact portions 56 of the receiving portion 50 is explained below with reference to FIGS. 6A-6C. FIG. 6A is a partially-enlarged lateral view of the key 3 and the hammer 4 in the key-pressing state. FIG. 6B is a partially-enlarged lateral view of the key 3 and the hammer 4 in the initial state. FIG. 6C is a partially-enlarged lateral view of the key 3 and the hammer 4 in a conventional keyboard device that does not include the contact portions 56.

The only difference between the conventional keyboard device of FIG. 6C and the keyboard device 1 of this invention is the existence of the contact portions 56. The other parts are identical and are assigned with the same reference numerals to facilitate the illustration.

In FIG. 6A and FIG. 6B, the rotation positions of the key 3 and the hammer 4 in the key-pressing state (see FIG. 2) are respectively defined as positions La0 and Lb0, the rotation positions of the key 3 and the hammer 4 in the initial state (see FIG. 1) are respectively defined as positions La1 and Lb1, and the rotation angles of the key 3 and the hammer 4 when they return from the key-pressing state to the initial state are respectively defined as angles θa and θb.

Similarly, in FIG. 6C, the rotation positions of the key 3 and the hammer 4 in the key-pressing state are respectively defined as positions Lc0 and Ld0, the rotation position of the key 3 right after the commencement of the key-releasing operation is defined as a position Lc1, and the rotation angle of the key 3 when the key 3 is rotated from the key-pressing state for a period of time right after the commencement of the key-releasing operation is defined as an angle θc.

As shown in FIG. 6A, in the key-pressing state (see FIG. 2) that the key 3 arrives at the key-pressing position (being pressed to the bottom in the key-pressing direction) and the receiving portion 50 is pushed downwards by the protrusion 34, the key 3 is in the position La0 and the hammer 4 is in the position Lb0. When the player removes his/her hand to release the key 3 from the key-pressing position, the hammer 4 rotates with the hammer supporting protrusion 43 as the center along the clockwise direction of FIG. 6A by its deadweight and the protrusion 34 is lifted upwards by the receiving portion 50 to rotate the key 3 with the key supporting protrusion 23 as the center along the anticlockwise direction of FIG. 6A.

In this case, the rotation of the hammer 4 driven by its deadweight starts relatively slow. By contrast, the key 3 is not only lifted by the hammer 3 but also receives reaction force from the first switch 62 and the second switch 63 (see FIG. 1 or FIG. 2), and therefore, the rotation of the key 3 starts relatively fast. For this reason, the conventional keyboard device of FIG. 6C that has no contact portion 56 encounters the situation that, before the rotation of the hammer 4 begins, namely, the hammer 4 is still in the position Ld0, the key 3 has rotated from the position Lc0 to the position Lc1 for the angle θc. Since the rotation of the key 3 precedes the rotation of the hammer 4, the protrusion 34 departs (jumps) from the sliding surface 52 of the receiving portion 50 and forms a gap between the protrusion 34 and the sliding surface 52. When the protrusion 34 of the preceding key 3 falls on (hits) the sliding surface 52 of the hammer 4 (receiving portion 50) that follows thereafter, noise occurs.

In this exemplary embodiment, however, the contact portions 56 are formed integrally with the receiving portion 50 that is made of a flexible material, and in the key-pressing state of FIG. 6A (namely, the key 3 is pressed to the bottom in the key-pressing direction and is in the key-pressing position), the contact portions 56 are elastically-deformed when contacting (close contact) the side surfaces of the protrusion 34. Therefore, even though the key 3 is pushed by the reaction force of the first switch 62 and the second switch 63, the key 3 can still be suppressed from rotating before the hammer 4. In other words, the key 3 and the hammer 4 is connected through the contact between the side surfaces of the protrusion 34 and the contact portions 56 to suppress the key 3 from rotating before the hammer 4.

Accordingly, the rotating speed of the hammer 4 from the position Lb0 to the position Lb1 for the angle θb can be proportioned to the rotation speed of the key 3 from the position La0 to the position La1 for the angle θa In addition, the protrusion 34 of the key 3 is lifted by the receiving portion 50 of the hammer 4, as shown in FIG. 6B. That is, the protrusion 34 can slide on the sliding surface 52 of the receiving portion 50 when the key 3 is released from the key-pressing state of FIG. 6A to the initial state of FIG. 6B, or the gap can be minimized if the protrusion 34 departs from the sliding surface 52 of the receiving portion 50. Therefore, the protrusion 34 can be prevented from departing from the sliding surface 52 to suppress the generation of noise that occurs when the protrusion 34 falls on (hits) the sliding surface 52.

The contact portions 56 are disposed in pair and opposite to each other on two sides to clamp the protrusion 34. Since the pair of contact portions 56 contacts the side surfaces of the protrusion 34 from two sides, the protrusion 34 can be clamped steadily by the contact portions 56 to stabilize the rotations of the key 3 and the hammer 4, thereby achieving the effects of improving durability and suppressing the influence on key touching.

Below a receiving portion 250 of the second embodiment is explained with reference to FIGS. 7A, 7B. FIG. 7A is a schematic top view of the receiving portion 250 according to the second embodiment. FIG. 7B is a schematic cross-sectional view of the receiving portion 250 along the line VIIb-VIIb of FIG. 7A. In FIG. 7B, the position of the protrusion 34 when the key 3 is in the key-pressing position (see FIG. 2) is represented by a two-dot chain line.

In the first embodiment, the first surface 52*a*, the bump portion 52*b*, and the second surface 52*c* are disposed on a part of the sliding surface 52. In the second embodiment, however, a sliding surface 252 is an entirely flat surface. In the second embodiment, parts that are identical to those of the first embodiment are assigned with the same reference numerals to facilitate the illustration.

As illustrated in FIG. 7A and FIG. 7B, in addition to the sliding surface 252 that is a flat surface, the receiving portion 250 of the second embodiment includes contact portions 256 which are disposed respectively on the opposite surfaces of the pair of wall portions 53.

The same as the contact portions 56 of the first embodiment, the contact portions 256 include contact parts configured to contact the side surfaces of the protrusion 34, and the parts that are closer to the side of the wall portion 54 (the left side of FIGS. 7A and 7B) than the contact parts and the parts on the top (the upper side of FIG. 7B) are curved in an arc shape. Moreover, an opposing interval between the contact parts is smaller than the thickness of the protrusion 34.

When the key 3 is pressed (downwards) from the initial state of FIG. 1 over a specific degree, the contact parts of the contact portions 256 come into contact with the side surfaces of the protrusion 43, and the contact area between the side surfaces of the protrusion 34 and the contact parts of the contact portions 256 increases with the pressing of the key. The contact area reaches the maximum when the key 3 is in the key-pressing position of FIG. 2 (the key 3 is pressed to the bottom in the key-pressing direction). FIG. 7B illustrates a situation that the key 3 is in the key-pressing position of FIG. 2, and the contact area between the contact parts of the contact portions 256 and the side surfaces of the protrusion 34 is represented by hatching for easy understanding.

Accordingly, even though the sliding surface 252 is a flat surface, the key 3 and the hammer 4 can still be connected through the contact between the contact portions 256 and the side surfaces of the protrusion 34 to suppress the key 3 from rotating before the hammer 4. Therefore, the protrusion 34 can be prevented from departing from the sliding surface 252 in the key-releasing operation to suppress the generation of noise that occurs when the protrusion 34 falls on (hits) the sliding surface 252.

Hereinafter, a receiving portion 350 of the third embodiment is explained with reference to FIGS. 8A, 8B and FIGS. 9A, 9B. In the first embodiment, the contact portions 56 of the receiving portion 50 are configured to contact the side surfaces of the protrusion 34 so as to prevent the protrusion 34 from departing from the sliding surface 52. In the third embodiment, however, the receiving portion 350 utilizes engagement elements 334*a* of the protrusion 334 that are engaged with guiding slots 353*a* to prevent the protrusion 334 from departing from the sliding surface 52. In the third embodiment, parts that are identical to those of the first embodiment are assigned with the same reference numerals to facilitate the illustration.

Figure 8A:
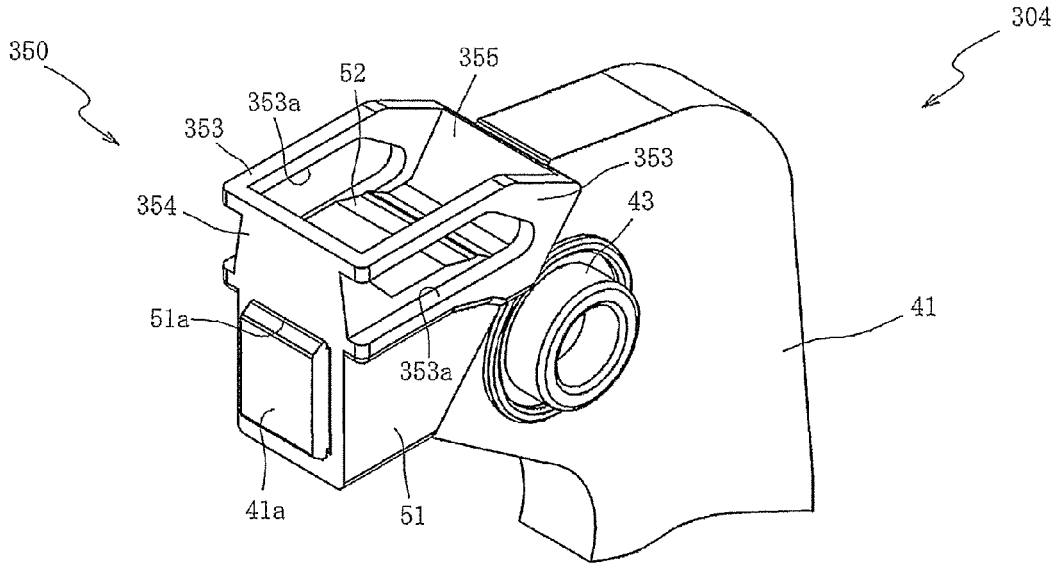
FIG. 8A is a schematic perspective view of a hammer according to the third embodiment.
Figure 8B:
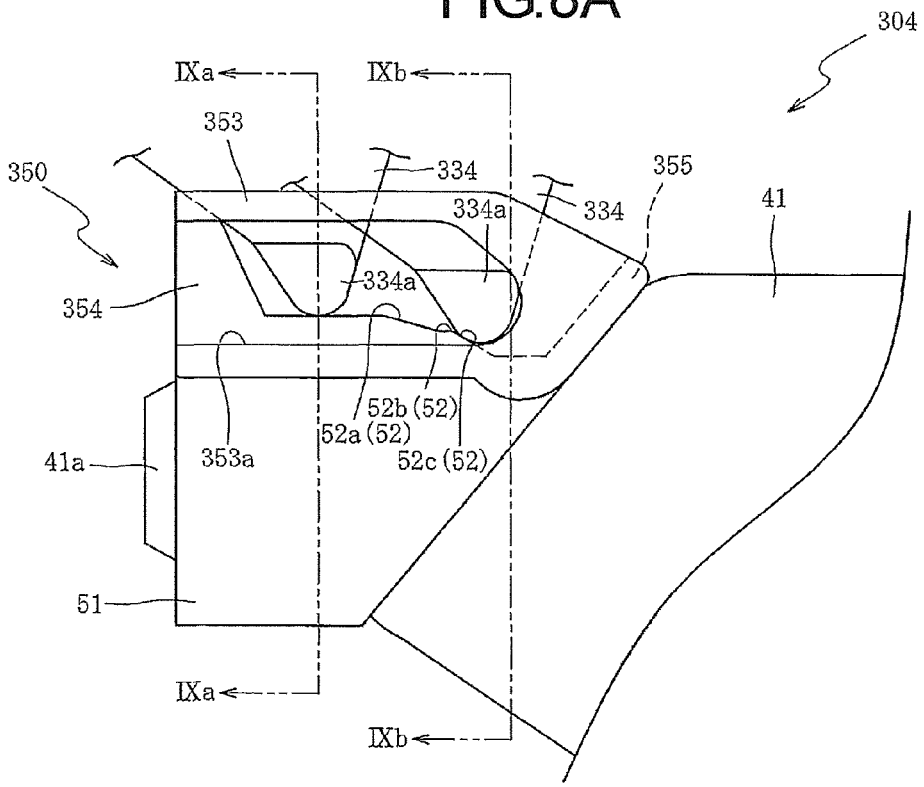
FIG. 8B is a schematic lateral view of the hammer.
Figure 9B:
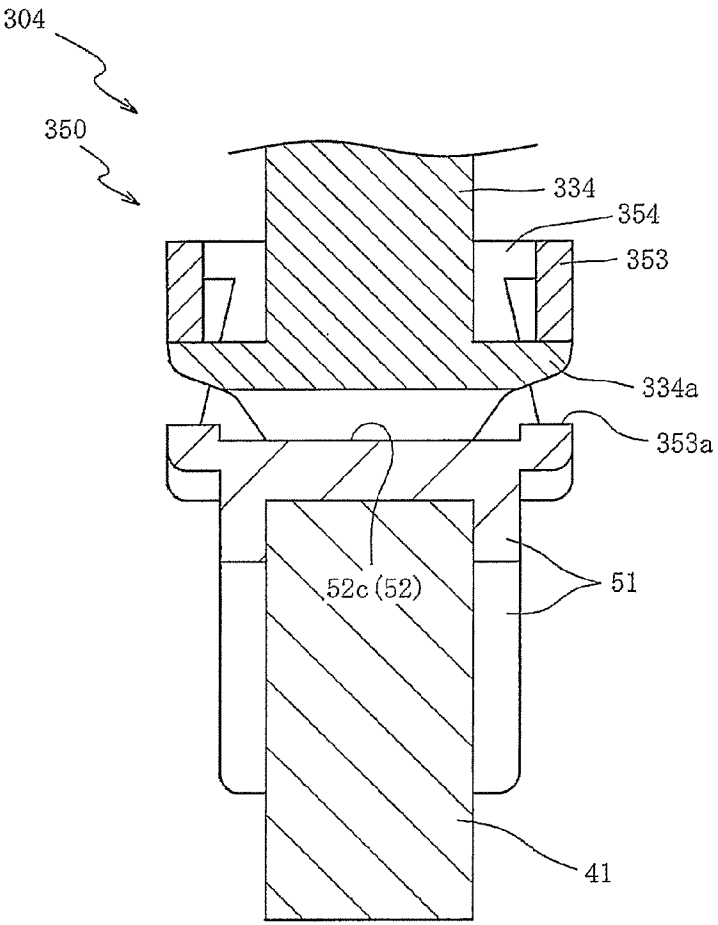
FIG. 9B is a schematic cross-sectional view of the receiving portion along the line IXb-IXb of FIG. 8B.
Figure 9A:
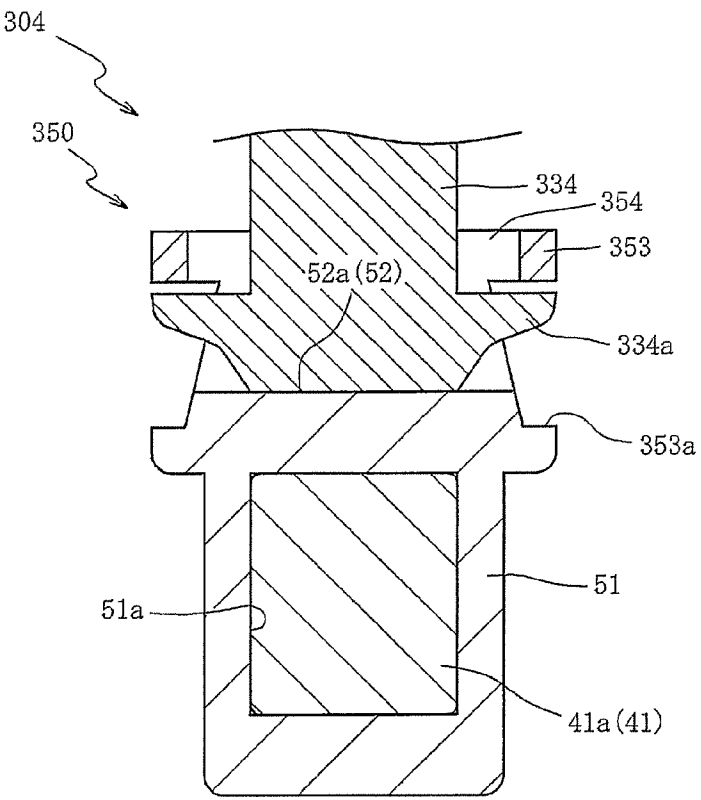
FIG. 9A is a schematic cross-sectional view of the receiving portion along the line IXa-IXa of FIG. 8B.

FIG. 8A is a schematic perspective view of a hammer 304 according to the third embodiment. FIG. 8B is a schematic lateral view of the hammer 304. FIG. 9A is a schematic cross-sectional view of the receiving portion 350 along the line IXa-IXa of FIG. 8B. FIG. 9B is a schematic cross-sectional view of the receiving portion 350 along the line IXb-IXb of FIG. 8B. FIG. 8B, FIG. 9A, and FIG. 9B respectively illustrate a state of the protrusion 334 (left side of FIG. 8B, FIG. 9A) when the key 3 is in the initial position (see FIG. 1) and a state of the protrusion 334 (right side of FIG. 8B, FIG. 9B) when the key 3 is in the key-pressing position (see FIG. 2).

As shown in FIGS. 8A, 8B and FIGS. 9A, 9B, the receiving portion 350 of the third embodiment includes a receiving body portion 51 and wall portions 353-355 that are disposed upright around the sliding surface 52 of the receiving body portion 51. These components are formed integrally with each other using a flexible material.

The wall portions 353 are extended in the sliding direction, along which the protrusion 334 slides on the sliding surface 52, and are arranged in pair opposite to each other with a specific interval therebetween. The pair of wall portions 353 is connected with the wall portions 354 and 355 respectively at one end and the other end thereof in the extending direction (the left side and right side of FIG. 8A and FIG. 8B).

The protrusion 334 includes a pair of engagement elements 334*a*. The engagement elements 334*a* are protrusions that extend outwards (the rear side and front side of the page surface of FIG. 8B) from the side surfaces of the front end (the lower side of FIG. 8B) of the protrusion 334 and are inserted into the guiding slots 353*a*, which will be described hereinafter. The guiding slots 353*a* are slot-shaped openings respectively formed on the pair of wall portions 353 for the engagement elements 334*a* of the protrusion 334 to be movably inserted thereinto, and the guiding slots 353*a* are extended along a track that the engagement elements 334*a* move when the protrusion 334 slides on the sliding surface 52 in the key-pressing operation.

Because the engagement elements 334*a* of the protrusion 334 are inserted into the guiding slots 353*a* of the wall portions 353 of the receiving portion 350, in the case that the rotation of the key 3 precedes the rotation of the hammer 304 upon releasing of the key due to the reaction force of the first switch 62 and the second switch 63 and causes the protrusion 334 to depart from the sliding surface 52, the engagement between the engagement elements 334*a* of the protrusion 334 and the inner surfaces of the guiding slots 353*a* suppresses the protrusion 334 from departing further from the sliding surface 52. In other words, the engagement between the engagement elements 334*a* of the protrusion 334 and the inner surfaces of the guiding slots 353*a* suppresses the key 3 from rotating before the hammer 304, like the first embodiment. Accordingly, the degree of departure of the protrusion 334 from the sliding surface 52 or the departure is suppressed to prevent the generation of noise that occurs when the protrusion 334 falls on (hits) the sliding surface 52.

Here, when the key 3 is in the key-pressing position (the key 3 is pressed to the bottom in the key-pressing direction) of FIG. 2, the protrusion 334 is in contact with the second surface 52*c* of the sliding surface 52 and a part of the engagement elements 334*a* of the protrusion 334 is in contact with the inner surfaces of the guiding slots 353*a*, as illustrated in FIG. 8B and FIG. 9B. Since the engagement elements 334*a* of the protrusion 334 are in contact with the inner surfaces of the guiding slots 353*a* when the key 3 is in the key-pressing position (the key 3 is pressed to the bottom in the key-pressing direction) of FIG. 2, the key 3 can be effectively suppressed from rotating before the hammer 304 when the key 3 is released from the key-pressing state, so as to prevent the protrusion 334 from departing from the sliding surface 52 and suppress the generation of noise that occurs when the protrusion 334 falls on (hits) the sliding surface 52.

Moreover, when the key 3 is in the key-pressing position (the key 3 is completely pressed in the key-pressing direction) of FIG. 2, a part of the engagement elements 334*a* of the protrusion 334 is in contact (close contact) with the inner surfaces of the guiding slots 353*a* and presses against the inner surfaces of the guiding slots 353*a* with a specific compression amount (in FIG. 9B, the engagement elements 334*a* push the wall portions 353 upwards via the upper inner surfaces (the upper side of FIG. 9B) of the guiding slots 353*a*).

When the key 3 is released from the key-pressing position of FIG. 2, the part of the engagement elements 334*a* of the protrusion 334 is released from the state of pressing against the inner surfaces of the guiding slots 353*a* with the specific compression amount, and a gap is formed between the inner surfaces of the guiding slots 353*a* and the engagement elements 334*a* of the protrusion 334 at least when the protrusion 334 slides on the first surface 52*a* and the bump portion 52*b*. Therefore, when the protrusion 334 slides through the first surface 52*a* and crosses over the bump portion 52*b* in the key-pressing operation, or when the protrusion 334 crosses over the bump portion 52*b* and slides through the first surface 52*a* in the key-releasing operation, the contact between the engagement elements 334*a* of the protrusion 334 and the inner surfaces of the guiding slots 335*a* is avoided to prevent the heavy touching sense of the key 3. As a result, such a configuration does not cause adverse influence to the simulated key touching sense (clicking sense) of an acoustic piano and can suppress the protrusion 334 from departing from the sliding surface 52 during releasing of the key, so as to suppress the generation of noise that occurs when the protrusion 334 falls on (hits) the sliding surface 52.

The invention is described with reference of the aforementioned exemplary embodiments. However, the invention is not limited thereto, and it can be deduced that various modifications and variations can be made without departing from the scope or spirit of the invention. For example, the values mentioned in the aforementioned exemplary embodiments are only used as an example, and other values may also be adopted.

The aforementioned exemplary embodiments illustrate a situation that the protrusion 34, 334 protruding from the key 3 is in contact with the sliding surface 52, 252 located behind the hammer supporting protrusions 43 (the left side of FIG. 1 and FIG. 2) while the mass body 42 of the hammer 4, 304 is rotated at the front side of the chassis 2 (the right side of FIG. 1 and FIG. 2). However, the invention is not limited thereto. It is certainly possible to change the shape of the chassis 2, the position of the received hammer 4, 304, or the position of the protrusion 34, 334, etc., to achieve a situation that the protrusion 34, 334 protruding from the key 3 is in contact with the sliding surface 52, 252 located in front of the hammer supporting protrusions 43 and the mass body 42 of the hammer 4, 304 is rotated at the rear side of the chassis 2.

The aforementioned exemplary embodiments illustrate a situation that the protrusion 34, 334 protrudes from the key 3 and the sliding surface 52, 252 is formed on the hammer 4, 304. However, the invention is not limited thereto. For instance, it is certainly possible to dispose the protrusion 34, 334 to protrude from a specific portion of the hammer 4, 304, and form the sliding surface 52, 252 on a specific portion of the key 3 for the protrusion 34, 334 to slide on the sliding surface 52, 252 in the key-pressing operation or the key-releasing operation. Similarly, it is also possible to protrude the protrusion 34, 334 from a specific portion of the hammer 4, 304 and form the sliding surface 52, 252 on a specific portion of the chassis 2 for the protrusion 34, 334 to slide on the sliding surface 52, 252 in the key-pressing operation or the key-releasing operation.

The aforementioned exemplary embodiments illustrate a situation that the noise prevention configuration (the contact portions 56, 256, or the engagement elements 334*a* and the guiding slots 353*a*) is installed to both the white keys 3*a* and the black keys 3*b*. However, the invention is not limited thereto. It is possible that the noise prevention configuration is installed to the black keys 3*b* only, and omitted from the white keys 3*a*. Because the white keys 3*a* are heavier than the black keys 3*b* and do not rotate before the hammer 4, 304 easily upon releasing of the key, noise does not occur easily. In this way, the noise can be prevented and the fabrication costs can be reduced.

The first and the second embodiments illustrate a situation that the contact between the contact portions 56, 256 and the side surfaces of the protrusion 34 only occurs at a part of a terminal side of a sliding range that the protrusion 34 slides on the sliding surface 52, 252. However, the invention is not limited thereto, and the contact between the contact portions 56, 256 and the side surfaces of the protrusion 34 may occur in the entire sliding range that the protrusion 34 slides on the sliding surface 52, 252. Similarly, in the third embodiment, the contact between the engagement elements 334*a* of the protrusion 334 and the inner surfaces of the guiding slots 353*a* may also occur in the entire sliding range that the protrusion 334 slides on the sliding surface 52, 252.

In the first and the second embodiments, a situation that the side surfaces of the protrusion 34 are flat surfaces is described. However, the invention is not limited thereto. For example, protrusions may be formed to protrude from the side surfaces of the protrusion 34 or ribs may be disposed upright on the side surfaces of the protrusion 34. Moreover, concaves or grooves may be disposed in recession on the side surfaces of the protrusion 34, or openings may be formed thereon.

The third embodiment illustrates a situation that the guiding slots 353*a* are formed in the wall portions 353 of the receiving portion 350 while the engagement elements 334*a* inserted into the guiding slots 353*a* are formed on the protrusion 334. However, the invention is not limited thereto. Slots (openings or grooves) that are equivalent to the guiding slots 353*a* may be formed on the protrusion 334, and elements equivalent to the engagement elements 334*a* that are inserted into the guiding slots 353*a* may be formed on the wall portions 353 of the receiving portion 350.

The aforementioned exemplary embodiments illustrate a situation that the first switch 62 and the second switch 63 are rubber switches, and when the first switch 62 and the second switch 63 are pressed by the switch pressing part 32, the reaction force (elastic recovery force) of the switches 62 and 63 is applied to the key 3 along the key-releasing direction. However, the invention is not limited thereto. For example, the first switch 62 and the second switch 63 may be non-contact optical sensors that detect the key-pressing state of the key 3 and provide no reaction force to the key 3.

In the case that the reaction force of the first switch 62 and the second switch 63 is not applied to the key 3, other forces may be applied to the key 3 along the key-releasing direction. In that case, the invention can still suppress the key 3 from rotating before the hammer 4 through the departure suppressing means (the contact portions 56, 256 or the engagement elements 334*a* and the guiding slots 353*a*). For example, said other forces may be the reaction force (elastic recovery force of the cushion material 27*a*, 27*d* when pressed by the key 3) of the cushion material 27*a*, 27*d* that is applied to the key 3. In other words, with the exception of the hammer 4, 304, components that may apply forces to the key 3 along the key-releasing direction are not limited to the first switch 62 and the second switch 63.

What is claimed is:

1. A keyboard device, comprising:

a chassis;

a key rotatably supported by the chassis;

a hammer rotatably supported by the chassis to be rotated along with pressing or releasing of the key, wherein the hammer rotated along with the pressing of the key is rotated back in a reverse direction due to a deadweight of the hammer;

a protrusion protruding from one of the key and the hammer; and a sliding surface disposed on an other one of the key and the hammer, and the protrusion sliding on the sliding surface along with the pressing of the key, and a departure suppressing means that suppresses a relative displacement of the protrusion in a direction away from the sliding surface when the key is released.

2. The keyboard device according to claim 1, further comprising at least one contact portion, which is disposed on the other one of the key and the hammer formed with the sliding surface and comprises a flexible material, wherein the at least one contact portion is in contact with a side surface of the protrusion at least in a state that the key is completely pressed in a key-pressing direction, and wherein the at least one contact portion is the departure suppressing means.

3. The keyboard device according to claim 2, wherein the at least one contact portion is a pair of contact portions disposed in pair and opposite to each other on two sides to clamp a movement track of the protrusion, and the pair of contact portions contact the side surface of the protrusion from two sides.

4. The keyboard device according to claim 2, further comprising a flexible portion which includes a flexible material, wherein the flexible portion comprises the sliding surface and the at lease one contact portion that are formed integrally with each other.

5. The keyboard device according to claim 4, wherein the sliding surface is disposed under the protrusion, and the flexible portion comprises a wall portion disposed upright around the sliding surface and surrounds the sliding surface; and the at least one contact portion is a pair of contact portions, disposed on inner surfaces of the wall portion, which face to the side surface of the protrusion, and extend along a sliding direction of the protrusion.

6. The keyboard device according to claim 5, wherein the at least one contact portion is formed in continuation with the sliding surface.

7. The keyboard device according to claim 2, wherein the sliding surface comprises:

a first surface which is a flat or curved surface inclined towards a direction that is along a sliding direction of the protrusion during the pressing of the key and departs from a base portion of the protrusion;

a bump portion which is formed in continuation with the first surface and rises up towards a direction that is along the sliding direction of the protrusion during the pressing of the key and approaches the base portion of the protrusion; and a second surface which is formed in continuation with the bump portion and is an area that the protrusion slides until the key is completely pressed to in the key-pressing direction after the protrusion crosses over the bump portion.

8. The keyboard device according to claim 7, wherein a gap is formed between the side surface of the protrusion and the at least one contact portion at least when the protrusion slides on the first surface and the bump portion.

9. The keyboard device according to claims 2, wherein the at least one contact portion comprise a plurality of convex portions which protrude from surfaces that contact the side surface of the protrusion.

10. The keyboard device according to claim 1, further comprising:

an engagement element protruding from the protrusion; and a guiding slot into which the engagement element is movably inserted and which is formed on the other one of the key and the hammer formed with the sliding surface, and the guiding slot extending along a track that the engagement element moves when the protrusion slides on the sliding surface during the pressing of the key, wherein the engagement element and the guiding slot are the departure suppressing means.

11. The keyboard device according to claim 10, wherein the engagement element is in contact with an inner surface of the guiding slot at least in a state that the key is completely pressed in a key-pressing direction.

12. The keyboard device according to claim 10, further comprising a flexible portion which includes a flexible material, wherein the flexible portion comprises the sliding surface and the guiding slot that are formed integrally with each other.

13. The keyboard device according to claim 10, wherein the sliding surface comprises:

a first surface which is a flat or curved surface inclined towards a direction that is along a sliding direction of the protrusion during the pressing of the key and departs from a base portion of the protrusion;

a bump portion which is formed in continuation with the first surface and rises up towards a direction that is along the sliding direction of the protrusion during the pressing of the key and approaches the base portion of the protrusion; and a second surface which is formed in continuation with the bump portion and is an area that the protrusion slides until the key is completely pressed in a key-pressing direction after the protrusion crosses over the bump portion.

14. The keyboard device according to claim 13, wherein a gap is formed between an inner surface of the guiding slot and the engagement element of the protrusion at least when the protrusion slides on the first surface and the bump portion.

* * * * *